US005193078A

United States Patent [19]

Zink et al.

[11] Patent Number: 5,193,078

[45] Date of Patent: Mar. 9, 1993

[54] UNI-DIRECTIONAL ROTATION DEVICE FOR A CAM-OPERATED TIMER

[75] Inventors: David E. Zink; Daniel K. Amonett, both of Indianapolis, Ind.

[73] Assignee: Emerson Electric Co., St. Louis, Mo.

[21] Appl. No.: 836,700

[22] Filed: Feb. 18, 1992

[51] Int. Cl.[5] ..... G04F 8/00; H01H 43/14

[52] U.S. Cl. ..... 368/107; 200/38 A; 200/38 FA

[58] Field of Search ..... 369/10, 107-113; 20/38 R, 38 B, 38 F, 38 FA, 38 D, 35 R, 35 H

[56] References Cited

U.S. PATENT DOCUMENTS 3,694,591 9/1972 Basett et al. ..... 200/38 FA
3,879,587 4/1975 Dragh ..... 200/35 R
3,909,565 9/1975 Clouser et al. ..... 200/38 R
3,930,359 1/1976 Flumm et al. ..... 200/38 FA

*Primary Examiner*—Vit W. Miska
*Attorney, Agent, or Firm*—Robert F. Meyer

[57] ABSTRACT

A uni-direction rotation device in a cam-operated timer is accomplished by coupling the timer control shaft to the camstack with a semi-circular tang and semi-circular slot connection. When the timer control knob is rotated in the biased or right direction, the slot is coupled to the tang, and the timer can be set. But when the timer control knob is rotated in the unbaised or wrong direction, the slot is uncoupled from the tang and the timer control knob rotates freely, so the timer cannot be set.

5 Claims, 3 Drawing Sheets

UNI-DIRECTIONAL ROTATION DEVICE FOR A CAM-OPERATED TIMER

BACKGROUND OF THE INVENTION

This invention relates to electromechanical timers used in controlling appliance functions where a selection of timer functions can be made by manually rotating a control knob on the timer. Electromechanical timers are widely used to control functions in automatic appliances. Such timers use a control knob to select various functions desired to be performed by the timer. Generally the control knob is fixed on a shaft that provides the rotational axis for a rotating cam. If the a timer shaft is rotated in a direction counter to its normal rotation or wrong direction, the improper rotation may cause damage to the timer's switch contacts, damage to the timer's drive means, and damage to the appliance by abrupt function changes.

In prior art timers, control knob rotation in the improper direction is prevented by attaching the control knob to the shaft with a threaded connection. If the user rotates the control knob in the wrong direction, the knob will unscrew from the shaft and the camstack will remain stationary.

SUMMARY OF THE INVENTION

Accordingly a mechanism is provided that prevents timer function selection when the control knob is rotated the wrong direction. In general the timing mechanism comprises a cam means, a switch means responsive to the cam means, a shaft means that provides a rotational axis for the cam means, and a coupling-decoupling means selectively engaging the shaft means to the cam means in response to a rotation of the shaft means in a predetermined direction.

DETAILED DESCRIPTION OF THE INVENTION

Figure 1:
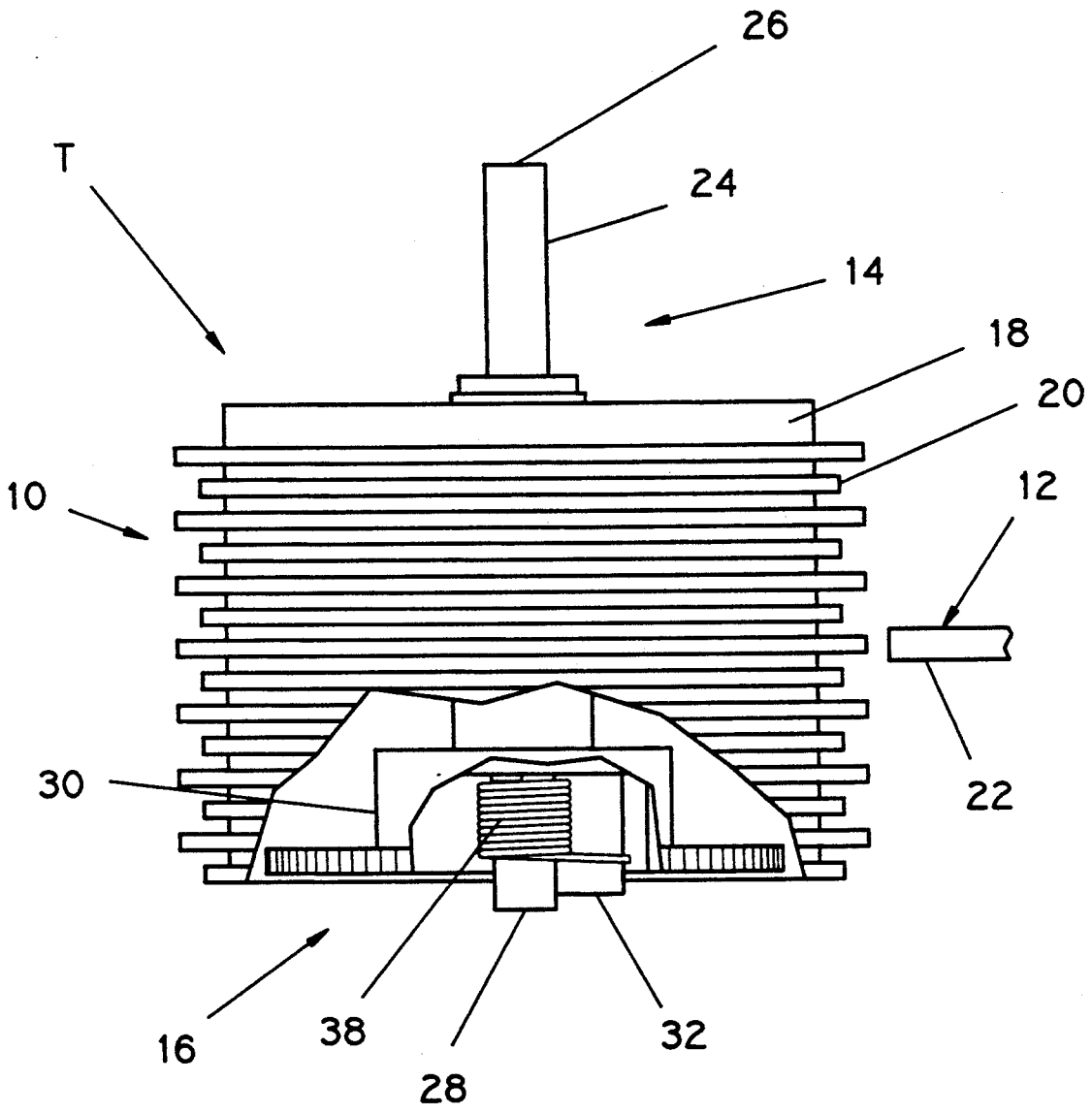
FIG. 1 is partially cut-away side view of the timer employing the features of the invention.

Referring to FIG. 1, a sectioned view of a cam-operated timer T is shown. The timer includes a cam means 10, a switch means 12 responsive to the cam means 10, a shaft means 14 coupled to the cam means 10, an a coupling-decoupling means 16 that selectively engages the shaft means 14 to the cam means 10.

The cam means 10 includes a camstack 18, having a plurality of cam profiles 10. The switch means 12 includes a plurality of switches 22, only one sown, that engage cam profiles 20 to be opened and closed. The shaft means 14 includes a shaft 24, having a control end 26 which is used to select appliance functions, a base end 28, and a flange 30.

Figure 2:
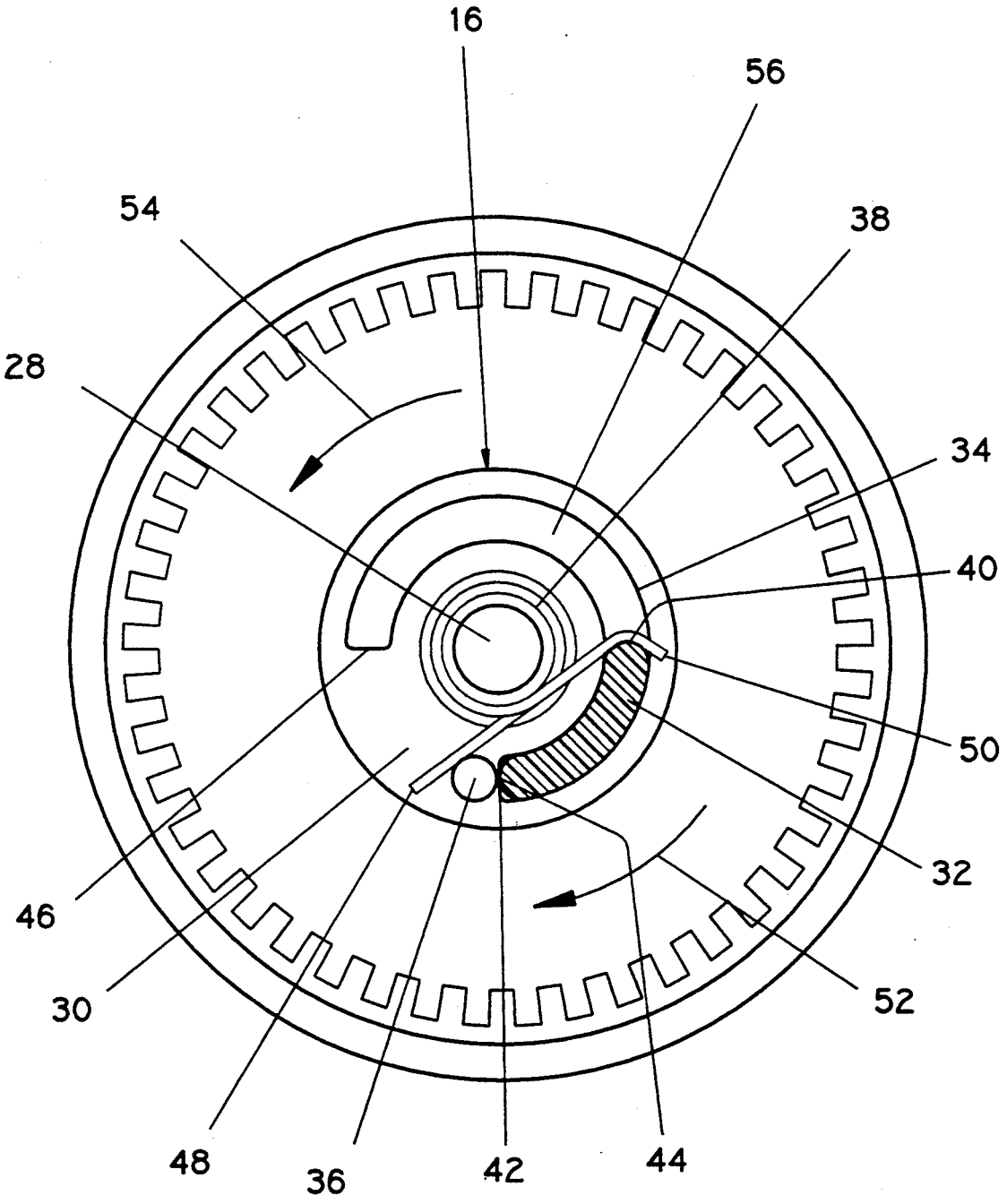
FIG 2 is a bottom view of the timer to better illustrate the invention.

Referring to FIG. 2, the coupling-decoupling means 16 includes a semi-circular tang 32 integral to the camstack 18, a semi-circular slot 34 integral to the shaft flange 30 wherein the semi-circular tang 32 is placed, a spring stop post 36 at one end of the semi-circular slot 34, a torsion spring 38 having one end against the semi-circular tang 32 which is integral to the camstack 18 and includes a biased end 40 and a stop end 44. The semi-circular tang 32 protrudes through the semi-circular slot 34. The semi-circular slot 34 is integral to the shaft flange 30 and includes a proper rotation stop 42, and an improper rotation stop 46.

The springs stop post 36 is attached to the shaft flange 30. The spring stop post 36 is positioned at the proper rotation stop 42 of the semi-circular slot 34. The torsion spring 38 is carried around the shaft base end 28 within the shaft flange 30. The torsion spring stationary end 48 rests against the spring stop post 36. The torsion spring biasing end 50 is placed on the semi-circular tang biased end 40.

An operational description of the device follows. FIG. 2 shows the semi-circular tang 32 in the biased position. In the biased position, the torsion spring biasing end 50 exerts pressure on the semi-circular tang biased end 40. This pressure causes the semi-circular tang 32 to have its stop end 44 against the semi-circular slot proper rotation stop 42. When the shaft control end 26 (FIG. 1) is rotated in the biased or proper direction 54 (FIG. 2), the proper rotation stop 42 at an end of the semi-circular slot 34 rotates against the semi-circular tang stop end 44. Since the semi-circular tang 32 is integral to the camstack 18, the rotational force applied by the semi-circular slot stop end 42 causes the camstack 18 to rotate, allowing the appliance operator to select a timer function.

Figure 3:
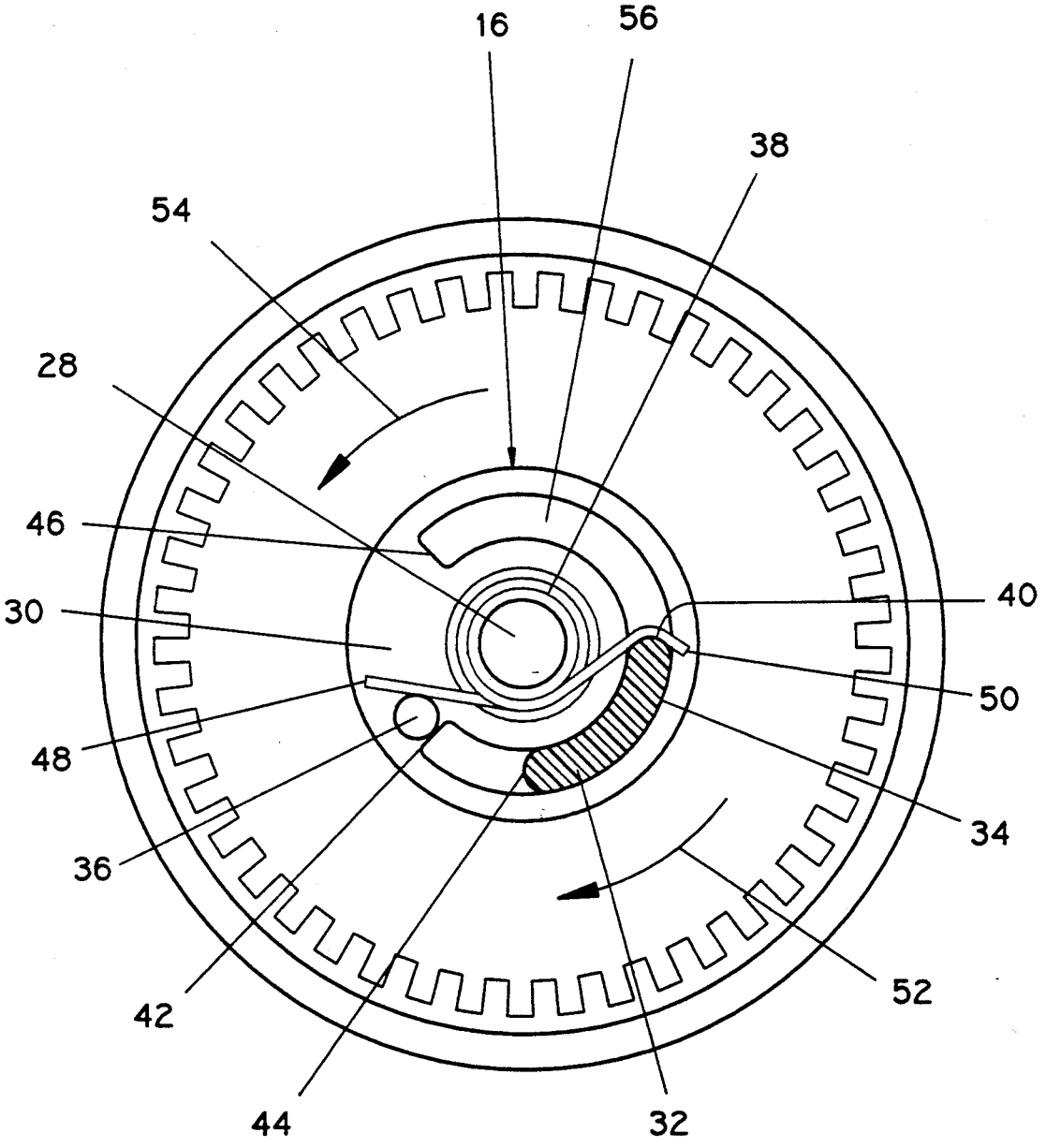
FIG. 3 is a bottom view of the timer employing the features of the invention in another operating position.

Referring to FIG. 3, the shaft control end 26 (FIG. 1) is rotated in the unbiased or wrong direction 52 (FIG. 3). The semi-circular slot proper rotation stop end 42 is rotated away from the semi-circular tang stop end 44. Rotation in the wrong direction 52 causes the semi-circular slot 34 to decouple from the semi-circular tang 32 and rotate freely in the free space 56 between the semi-circular slot improper rotation stop 46 and the semi-circular tang biased end 40. If the appliance operator releases the shaft control end 26 (FIG. 1) while the semi-circular tang 32 (FIG. 3) is in the free space 56, the torsion spring 38 will return the semi-circular slot proper rotation stop end 42 to the biased position against the semi-circular tang stop end 44. The return of the semi-circular slot 34 to the biased position will also return the shaft control end 26 (FIG. 1) to the position the shaft control end 26 was in prior to the attempt by the appliance operator to rotate the shaft control end 26 in the wrong direction 52 (FIG. 3).

If the shaft control end 26 (FIG. 1) is rotated in the wrong direction 52 (FIG. 3) for an arc greater than the free space 56, the semi-circular slot improper rotation stop end 46 will meet the semi-circular tang biased end 40, and the semi-circular tang 32 will be rotated in the wrong direction 52 causing the timer to be operated in the wrong direction 52.

What is claimed is:

1. A cam-operated timer comprising:

(a) a cam means, (b) a shaft means providing a rotational axis for said cam means, and (c) a coupling-decoupling means selectively engaging said shaft means to said cam means in response to rotation of said shaft means in a predetermined direction comprising:

(1) a semi-circular tang protruding from said cam means, (2) a semi-circular slot integral to said shaft means wherein said semi-circular tang is placed, (3) a spring stop post attached to said shaft means, and (4) a torsion spring having one end engaging said semi-circular tang and one end engaging said spring stop post.

2. A timing mechanism according to claim 1 wherein said coupling-decoupling means further comprises a semi-circular slot integral to said shaft means engaging a semi-circular tang with an arc greater than that of said semi-circular tang.

3. A timing mechanism according to claim 1 wherein said coupling-decoupling means further comprises a spring stop post attached to said shaft means for fixing a stationary end of a torsion spring.

4. A timing mechanism according to claim 1 wherein said coupling-decoupling means further comprises a torsion spring carried around said shaft having one end engaging a semi-circular tang and one end engaging a spring stop post to bias said semi-circular tang against an end of a semi-circular slot.

5. In a cam-operated timer, a method for coupling and decoupling a a shaft control end from a camstack depending upon a predetermined direction of rotation of the shaft control end, comprising the steps of:

(a) connecting the shaft control end to the camstack for rotation with a tang integral to the camstack that engages a semi-circular slot, with a larger circumference than said tang, attached to the shaft control end;

(b) biasing said tang with a spring against an edge of said semi-circular slot;

(c) coupling the camstack to the shaft control end when rotated in a biased direction when said tang applies rotational force to said semi-circular slot; and, (d) decoupling the control knob from the camstack to prevent rotation in an unbiased direction when said tang applies rotational force to one end of said spring.

* * * * *